United States Patent [19]

Celli

[11] Patent Number: 4,597,237

[45] Date of Patent: Jul. 1, 1986

[54] MODULAR WALL PANEL AND BUILDING WALL CONSTRUCTED THEREFROM

[76] Inventor: Aldo Celli, Via Jacopo Palma 9, 20146 Milano, Italy

[21] Appl. No.: 569,592

[22] Filed: Jan. 11, 1984

[51] Int. Cl.[4] ..... E04B 2/00; E04C 2/04

[52] U.S. Cl. ..... 52/601; 52/576; 52/577; 52/405; 52/583; 52/588; 428/178

[58] Field of Search ..... 52/601, 576, 405, 477, 52/588, 587, 583, 612; 428/178, 117, 118

[56] References Cited

U.S. PATENT DOCUMENTS

| | | | |
|---|---|---|---|
| 550,612 | 12/1895 | Hammerstein | 52/577 |
| 948,541 | 2/1910 | Coleman | 52/405 |
| 2,017,441 | 10/1935 | Kotrbaty | 52/405 |
| 2,101,181 | 12/1937 | Johnson | 52/601 |
| 2,101,612 | 12/1937 | Duffy . | |
| 2,103,407 | 12/1937 | Dean | 52/588 |
| 2,257,001 | 9/1941 | Davis | 52/601 |
| 2,703,004 | 3/1955 | Kenedy | 52/601 |
| 2,736,406 | 2/1956 | Johnson | 52/588 |
| 2,754,235 | 7/1956 | Wesner | 52/576 |
| 3,003,599 | 10/1961 | Rubisson | 428/178 |
| 3,623,291 | 11/1971 | Dussel | 52/405 |
| 3,676,973 | 7/1972 | Kellery | 52/601 |
| 3,724,152 | 4/1973 | Castellarin | 52/612 |
| 3,750,355 | 8/1973 | Blum | 52/612 |
| 3,831,339 | 8/1974 | Piralli | 52/601 |
| 4,011,701 | 3/1977 | Turkia | 52/587 |
| 4,185,437 | 1/1980 | Robinson | 52/601 |
| 4,313,993 | 2/1982 | McGlory | 428/178 |

FOREIGN PATENT DOCUMENTS

| | | | |
|---|---|---|---|
| 831903 | 1/1952 | Fed. Rep. of Germany | 52/601 |

*Primary Examiner*—Carl D. Friedman
*Assistant Examiner*—Michael Safavi
*Attorney, Agent, or Firm*—Barnes, Kisselle, Raisch, Choate, Whittemore & Hulbert

[57] ABSTRACT

A panel for modular construction of building walls and the like which comprises a flat insulating core which includes a multiplicity of air-filled shell-like cavities in a staggered matrix of layered sheets which are separated from each other by a binding filler material. The core is surrounded and captured by a rigid rectangular frame having identical side members and identical end members which are contoured and oriented so as to engage the opposing side and end members of adjacent panels so as to align and fasten the panels to each other in assembly. Resilient sealing means are disposed between side and end rails of adjacent panels for forming an air-tight barrier across the assembled panels. The core is covered by facing layers of cement and gypsum construction for providing building exterior and interior wall surfaces respectively. A vapor barrier is sandwiched between layers of gypsum construction.

15 Claims, 8 Drawing Figures

62
54
60
50
64
61
58
56
52
36
69
67
24
12
16
80
92
96
98
17
18
90
84
20
104
74
76
40
46
42
48
32
44
100
102
106
72

MODULAR WALL PANEL AND BUILDING WALL CONSTRUCTED THEREFROM

The present invention is directed to construction of building walls, and more particularly to modular wall panels adapted to be assembled to each other at a building site to form an interior or exterior building wall.

It is an object of the present invention to provide a modular wall panel which is economical to fabricate in the factory and which is easy to use at a building site for rapid construction of building interior or exterior walls.

Another object of the present invention is to provide a durable modular wall panel and a building wall constructed therefrom.

A further object of the invention is to provide a modular wall panel which finds particular utility in construction of building exterior walls, but which also is adapted with minor modification for use in construction of building interior walls.

In furtherance of that aspect of the invention which contemplates construction of building exterior walls, yet another object of the invention is to provide a modular wall panel and wall constructed therefrom which exhibits superior thermal insulation properties.

The invention, together with additional objects, features and advantages thereof, will be best understood from the following description, the appended claims and the accompanying drawings in which:

Figure 1:
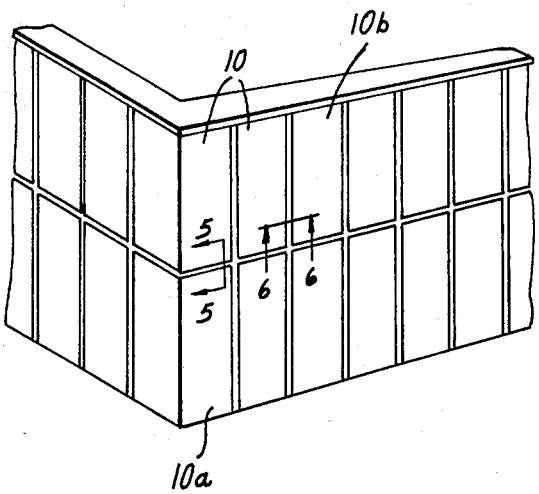
FIG. 1 is a fragmentary perspective view of a building having exterior walls constructed using the modular wall panel of the present invention.
Figure 2:
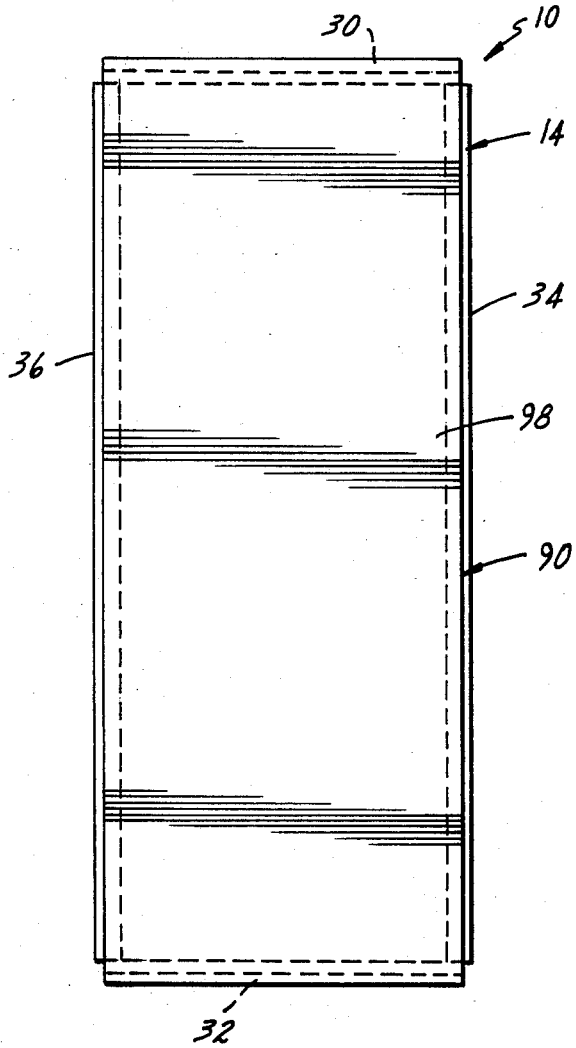
FIG. 2 is a front elevational view of a modular wall panel in accordance with a presently preferred embodiment of the invention.
Figure 5:
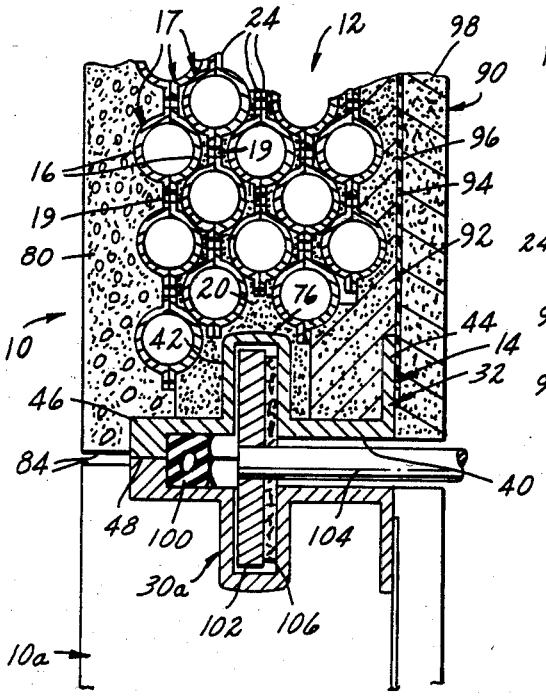
Figure 6:
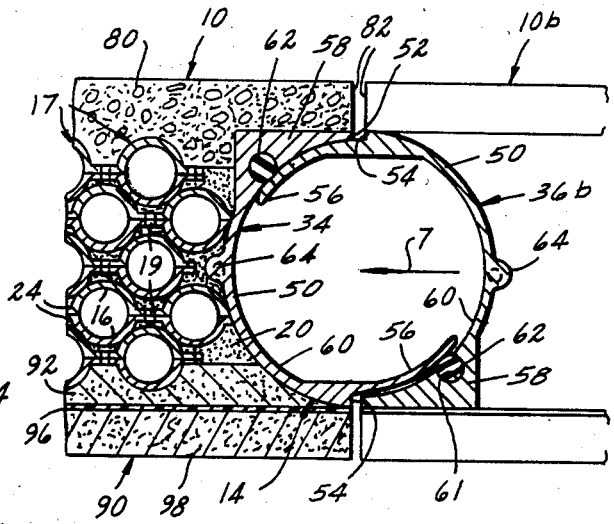
Figure 7:
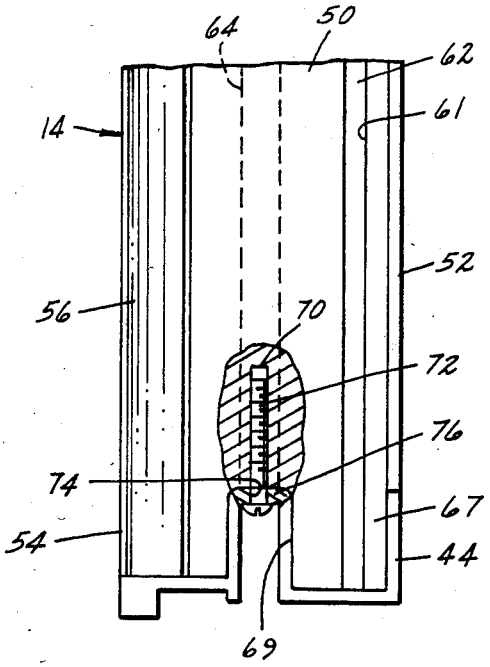
Figure 8:
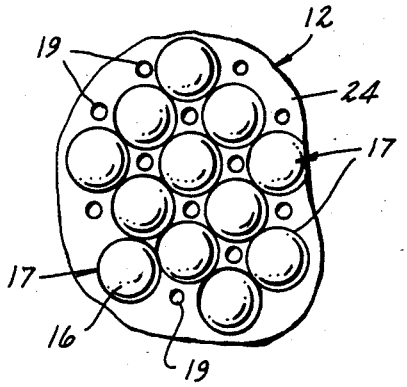

FIGS. 5 and 6 are fragmentary sectional views illustrating interconnection of adjacent panels in accordance with the invention and taken substantially along the respective lines 5—5 and 6—6 in FIG. 1;

FIG. 7 is a fragmentary partially sectioned elevational view taken substantially from the direction 7 in FIG. 6 and illustrating interconnection of the side and end frame members in each panel according to the invention; and FIG. 8 is a fragmentary elevational view of the exterior surface of the panel insulating core in accordance with the preferred embodiment of the invention illustrated in the drawings.

The drawings illustrate a presently preferred embodiment 10 of a modular building exterior wall panel in accordance with the present invention as comprising a flat rectangular insulating core 12. Insulating core 12 comprises a multiplicity of sheets 24 each having a patterned row-and-column array of hemispherical pockets or embossments 16 formed therein. Sheets 24 are adhered to each other in pairs with embossments 16 in opposed registry to form a planar array of spherical shell-like cavities 17 interconnected with each other by an integral web 18. A plurality of opposed sheet pairs so formed are assembled, with the spherical cavities of each sheet staggered or offset so as to be positioned between those of the next-adjacent sheet pair, and the space between each sheet pair is filled with a binder 20 of epoxy, for example. Apertures 19 are formed in web 18 between adjacent cavities 17 to permit free flow of binder material between sheet pairs. Sheets 24 may be preformed of flexible paper-mache, for example. Core 12 preferably is assembled so that a volume of air is sealed within each spherical cavity 17.

Figure 4:
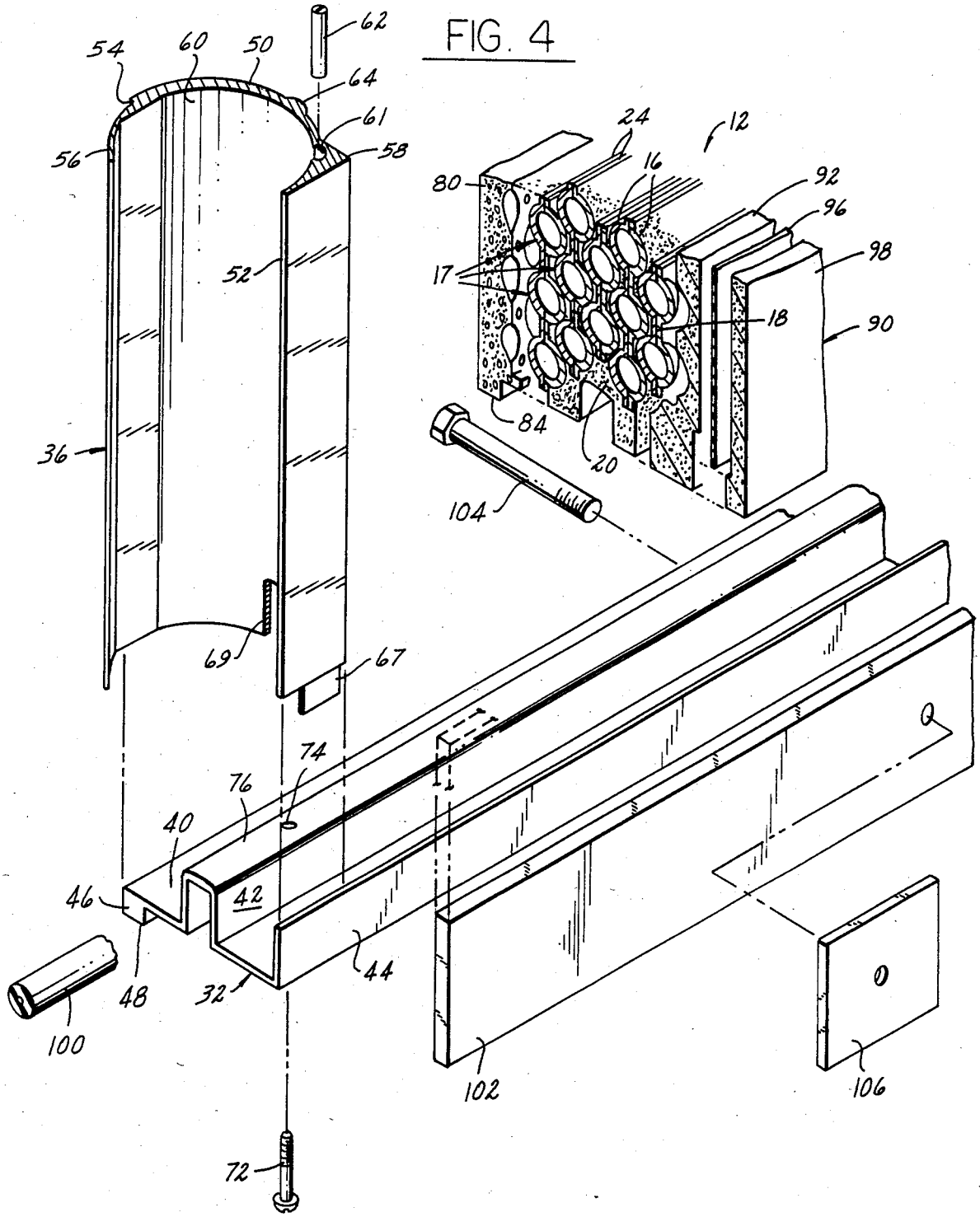
FIG. 4 is a fragmentary exploded perspective view of the modular wall panel of the invention.

A rigid rectangular frame 14 surrounds and captures the end and side edges of rectangular core 12. Frame 14 includes upper and lower end rails 30,32, respectively, and a pair of laterally spaced side rails 34,36. End rails 30,32, which are identical to each other, and side rails 34,36, which are likewise identical to each other, are interconnected at their adjacent ends at the corners of frame 14. Referring in particular to FIGS. 4, 5 and 7, the cross section of end rail 32 includes a flat portion 40 having a central depression or channel 42 which projects into and is embedded in binder 20 of core 12. One edge of flat-portion 40 terminates in a lip 44 which projects toward core 12. The opposing edge of portion 40 terminates in a lip 46 which projects outwardly or away from core 12. Lip 46 is relatively thick and terminates in a flat surface 48 parallel to flat portion 40. End rail 30 is identical to rail 32 but is oriented in the opposite direction. Thus, FIG. 5 illustrates the end rail 32 of upper panel 10 and the end rail **30*a* of the next lower panel 10*a* in assembly, rails 32,30*a*** being arranged as mirror images of each other.

Figure 3:
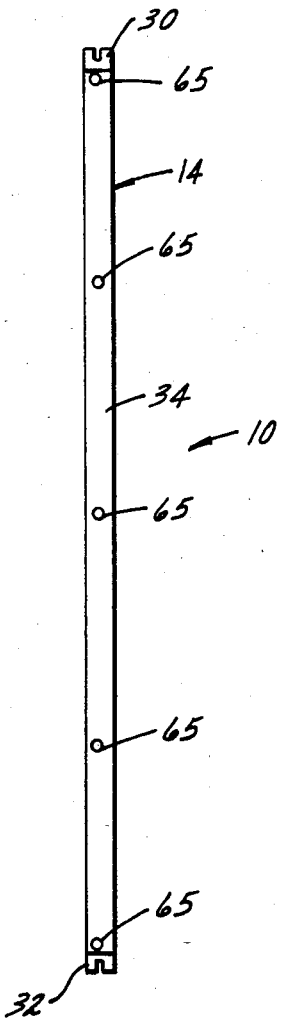
FIG. 3 is a side elevational view of the panel illustrated in FIG. 2.

Referring to FIGS. 4, 6 and 7, frame side rails 34,36 each comprise a generally semi-cylindrical body 50 with a concave central portion embedded in core 12 and coplanar edges 52,54 which define the lateral edges of panel 10. An arcuate flange 56 integrally projects from edge 54 at a constant radius of curvature which is less than the radius of the outwardly facing concave surface 60 of body 50. Adjacent to edge 52, body 50 is thickened at 58, and a part-cylindrical channel 61 is formed therein to extend entirely along body 50 and open onto the surface 60. A resilient sealing strip 62 within channel 61 projects outwardly from surface 60. A rib 64 extends along the convex side of body 50 at the apex thereof and is embedded within binder 20. Weep openings 65 (FIG. 3) are spaced lengthwise of rails 34,36.

The identical side rails 34,36 are not mounted as mirror images of each other, as are end rails 30,32. Rather, side rails 34,36 are mounted within frame 14 so that the flange 56 of one side rail is adjacent to a preselected surface (interior or exterior) of panel 10, and the flange 56 of the other side rail is adjacent to the other panel surface. In the particular embodiment shown in the drawings, the flange 56 of side rail 34 is adjacent to the interior panel surface, and the flange 56 of rail 36 is adjacent to the exterior panel surface. FIG. 6 illustrates orientation of frame side rail 34 of panel 10 and frame side rail **36*b* of laterally adjacent panel 10*b***.

Frame side rails 34,36 and end rails 30,32 are of uniform cross section throughout their respective lengths, and may be of extruded aluminum, for example. The frame rails are cut to desired lengths, and the ends of side rails 34,36 are contoured as shown in FIG. 7 to provide slots 69 for receiving channels 42 and flanges 67 for receipt within lips 44 of the end rails. A hole 70 is then drilled in rib 64 at each end of side rails 34,36. The side and end rails are then assembled to each other with screws 72 extending through predrilled holes 74 at the base 76 of each channel 42 into holes 70 at each corner of frame 14. It will be noted in FIG. 7 that all frame rails 30–36 have identical depth dimensions.

Preferably, core 12 is preformed in a molding operation with recesses adapted to receive bodies 50 of side rails 34,36 and channels 42 of end rails 30,32. Frame 14 is then assembled as described, and core 12 is placed therewithin by flexing core 12 and snapping the core edges over channels 42 and bodies 50. To facilitate assembly, the base 76 of channel 42 is arcuate, as best seen in FIG. 5. As alternative methods of assembly, frame 14 may be assembled around a premolded core 12, or core 12 may be molded with a preassembled frame 14.

After the core 12 and frame 14 have been assembled, interior and exterior panel facings are applied thereto. In the embodiment of the drawings, exterior facing 80 is of mortar or other cement-based construction, and may be preformed and assembled onto the core and frame, or more preferably is molded over the core and frame. The side edges 82 of exterior facing 80 are coplanar with frame side member edges 52,54 (FIG. 6), and the end edges 84 of exterior facing 80 are recessed with respect to frame end rail surfaces 48 (FIG. 5) so that end rail lips 46 project therefrom. The interior facing 90 of panel 10 comprises a first layer 92 of gypsum or the like molded onto the core and frame, with an exposed surface 94 coplanar with the exposed surfaces of lips 44 and edges 54,52. A preformed sheet 98 of gypsumboard or the like is assembled over layer 92, with a sheet 96 of polyethylene or the like sandwiched therebetween to form a vapor barrier.

To form a building wall, panels 10 are assembled to each other in a planar array, with the sides and ends of each panel interengaged with those of the next adjacent panels. Referring to FIG. 6, each panel 10 is interconnected with the panel **10*b* on the next adjacent side by receipt of the flanges 56 into the interior cavity of the opposing side rail. It will be noted that each flange 56 engages the strip seal 62 of the opposing side rail. Such engagement effectively forms a double barrier to seal against air flow from exterior to interior, and vice versa. As shown in FIG. 5, the end rail lip surfaces 48 abut in assembly. A strip seal 100 is retained between each pair of opposed frame end rails 32,30 adjacent to abutting lips 46. A metal retainer strap 102 is received in aligned end rail channels 42 and extends lengthwise across the width of panels 10,10*a*. Openings are formed in strap 102 through which bolts 104 extend for mounting of ceiling and floor frame members (not shown). A gasket 106 surrounds each bolt 104. Panels 10** are held in assembly by suitable framing (not shown) to form a building wall.

The modular panels herein disclosed fully satisfy all of the objects and aims previously set forth. For example, panels 10 may be fully constructed in the factory, shipped to the building site and rapidly assembled to form exterior walls of superior insulating quality. The exterior and interior surfaces may be tailored at the factory as desired. To form interior walls, panels 10 may be modified by replacing mortar facing layer 80 with a plaster layer similar to facing layer 92. Gypsumboard layer 98 and vapor barrier 96 may be deleted where use for interior walls is contemplated. Core 12 provides good sound and thermal insulation in either interior or exterior wall use.

The invention claimed is:

1. A panel for modular construction of a building wall or the like comprising a flat rectangular core of thermal insulating construction and a rigid rectangular frame assembly surrounding and capturing said core, said rigid rectangular frame assembly comprising identical frame side rails extending along laterally spaced sides of said core and identical frame end rails extending along longitudinally spaced ends of said core, said side rails being oriented oppositely of each other and said end rails being oriented oppositely of each other outwardly of said core and being structured for interengagement with identical complimentarily oriented rails of adjacent panels in assembly to form a building wall, each of said frame side rails comprising a rigid body having a semicylindrical recess extending entirely along said body, and an integral arcuate flange projecting laterally outwardly from one side edge of said recess and having a part-cylindrical contour at a lesser radius of curvature than said recess, said flanges of said side rails on said panel being disposed adjacent to opposite faces of said core means so that each said flange is positioned and oriented to extend into and nest within a side member recess of an adjacent panel in assembly and so that each said recess is positioned and oriented to receive a side rail flange of an adjacent panel in assembly, each said side rail further including a pocket in said semicylindrical recess extending throughout the length of said member, and resilient sealing means in said pocket and projecting into said recess so as to be engaged by the flange of an adjacent panel to form an air-tight seal between laterally adjacent panels.

2. The panel set forth in claim 1 further comprising resilient sealing means carried by each of said end rails and positioned to be engaged in assembly in a wall by end rails of adjacent panels to form air-tight seals between adjacent panels.

3. The panel set forth in claim 1 wherein said core comprises a plurality of closed hollow pockets surrounded by and captured within a filler material.

4. The panel set forth in claim 3 wherein said plurality of pockets comprise a multiplicity of sealed hollow shells.

5. The panel set forth in claim 4 wherein said multiplicity of hollow shells are disposed in a matrix of predetermined configuration within said filler material.

6. The panel set forth in claim 5 wherein said shells are disposed in staggered spaced planes, with the shells in each said plane being positioned between shells of adjacent planes, the spaces between said planes being filled with said filler material.

7. The panel set forth in claim 6 wherein said core comprises a plurality of sheets disposed in spaced layers, each said sheet comprising a plurality of said shells interconnected by an integral web.

8. The panel set forth in claim 7 wherein the interior of each said hollow shell is filled with air.

9. The panel set forth in claim 1 wherein each of said end rails comprises a rigid body having a channel which projects into said core.

10. The panel set forth in claim 9 wherein said side and end rails are of extruded metallic construction.

11. The panel set forth in claim 1 further comprising facing means forming opposite faces of said core and covering said core.

12. The panel set forth in claim 11 adapted for use in exterior wall construction wherein said facing means includes gypsum material on an interior side of said core means and cement-based material on an exterior side of said core means.

13. The panel set forth in claim 12 wherein said facing means comprises two layers of gypsum material on one side of said core means and a vapor barrier of water-impermeable sheet construction sandwiched between said layers.

14. A modular wall assembly comprising a plurality of laterally and vertically adjacent panels, each said panel comprising a flat insulating core and a rigid rectangular frame surrounding and capturing said core, said frame comprising opposite end rails having channels which project into said core, said channel of one end rail being opposed to a channel of an adjacent end rail and laterally spaced side rails ehch having a semicylindrical outwardly facing recess extending throughout the length of said side rail and an integral part-cylindrical flange extending along one side of said recess at a lesser radius than said recess, the said flanges on side members of each said panel being adjacent to opposite faces of said core, each said flange being received within the said recess of a laterally adjacent panel in said wall assembly so as to align and fasten said laterally adjacent panels to each other, a retainer strap positioned between vertically adjacent panels and received in said channels so as to align and fasten vertically adjacent panels to each other and resilient sealing means captured between opposing said rails to form an air-tight seal between said adjacent panels, said resilient sealing means comprising a pocket in each said side rail extending along said recess at a position adjacent to the said flange received in said recess from said laterally adjacent panel, and a strip of resilient sealing means disposed in said pocket and engaged by said flange of said laterally adjacent panel.

15. The modular wall assembly set forth in claim 14 wherein said resilient sealing means further comprises opposed flanges on said end rails and a second strip of resilient sealing means disposed between said end rails adjacent to said flanges.

* * * * *